US005297925A

United States Patent [19]

Lee et al.

[11] Patent Number: 5,297,925

[45] Date of Patent: Mar. 29, 1994

[54] WATER COLUMN FLOATING PUMP

[76] Inventors: Sek-Wah Lee, 734 22nd Ave., San Francisco, Calif. 94121; John C. Lee, 990 Kelley Ct., Lafayette, Calif. 94549

[21] Appl. No.: 812,562

[22] Filed: Dec. 20, 1991

[51] Int. Cl.[5] ..... F01D 25/28

[52] U.S. Cl. ..... 415/7; 415/71; 415/73; 416/84; 416/85

[58] Field of Search ..... 415/6, 7, 8, 71, 72, 415/73, 74, 75; 417/423.1; 416/84, 85

[56] References Cited

U.S. PATENT DOCUMENTS

| | | | |
|---|---|---|---|
| 28,526 | 5/1860 | Wappich | 415/72 |
| 1,023,378 | 4/1912 | Hay | 415/7 |
| 1,129,419 | 2/1915 | Noller | 415/72 |
| 1,142,089 | 6/1915 | Grimes | 416/177 |
| 2,362,922 | 11/1944 | Palm | 415/74 |
| 2,859,946 | 11/1958 | Boyle et al. | 415/6 |
| 3,176,621 | 4/1965 | Phillips | 415/72 |
| 3,431,855 | 3/1969 | Kazantsey et al. | 415/72 |
| 4,045,148 | 8/1977 | Morin | 416/84 |
| 4,116,099 | 9/1978 | Daubin | 114/264 |
| 4,170,436 | 10/1979 | Candler | 415/73 |
| 4,412,417 | 5/1981 | Dementhon | 60/497 |
| 4,793,767 | 12/1988 | Lundin | 415/62 |
| 4,813,849 | 3/1989 | Grujanac et al. | 416/177 |

FOREIGN PATENT DOCUMENTS

| | | | |
|---|---|---|---|
| 2401714 | 7/1975 | Fed. Rep. of Germany | 415/73 |
| 2225 | of 1904 | United Kingdom | 415/72 |

*Primary Examiner*—Thomas E. Denion

*Attorney, Agent, or Firm*—Majestic, Parsons, Siebert & Hsue

[57] ABSTRACT

This new invention, the water column floating pump, is a fluid pump which uses a rotationally symmetric container to pump fluid from an inlet reservoir to the outlet end of the rotationally symmetric container. The rotationally symmetric container is adapted to float with its axis of rotation vertical in a pump flotation chamber. The rotationally symmetric container floats and rotates in the fluid being pumped and uses the buoyancy of the fluid to carry its weight. A plurality of helically spiralling conduits proximate the periphery of the symmetric container forms a system of vacuum suction tubes designed to suck water from the inlet reservoir, proximate the bottom of the fluid pump, to the outlet end proximate the top of the container. The rotationally symmetric container operates at low rotational speed and requires a small horsepower motor to overcome water friction and water pressure. Under normal operation, the fluid filled spiral conduits form a heavy mass on the periphery of the rotationally symmetric container. This heavy rotating peripheral mass, in turn, generates sufficient centrifugal force and high torque to push fluid upward continuously from the inlet end of the rotationally symmetric container, through the helically spiralling conduits, and to discharge the fluid through the outlet end into the flotation chamber.

14 Claims, 15 Drawing Sheets 60
64
130
66
2
2
22
132
124
10
62
52
53
50
99
110
54
76
16
95
3
3
108
48
17
96
112
78
97
12
101
95'
68
13
98
78
26
28
4
4
78
30
32
32
44
18
14
42
80
5
5
100
104
106
106
104
82
34
86
40
88
36
92
90

60
64
130
66
2
2
22
10
132
124
62
52
53
50
54
99
110
3
3
76
16
95
108
48
17
96
112
97
78
12
101
95'
68
13
98
78
26
28
4
4
78
32
32
44
18
14
42
80
5
5
100
104
106
106
104
82
34
40
86
88
36
92
90

WATER COLUMN FLOATING PUMP

BACKGROUND OF THE PRIOR ART

This invention relates generally to fluid pumps and in particular centrifugal and screw type fluid pumps.

Many of the screw type fluid pumps of the prior art were tilted at an angle to the level of fluid being pumped so that the fluid would be captured between the helical screw blades and the cylindrical wall of the pumping container. As the pump drive rotated the screw, the water would be trapped and move up the cylinder to be discharged out of the top of the tube.

Other screw type pumps used both a rotating helical screw and a contra-rotating cylinder equipped with outward directed feed vanes at the collector end of the rotating screw. The feed vanes were used to deliver the highly viscous feed material into the intake end of the screw to force the material onto the feed screw.

All the prior art screw type pumps operated at generally low rotational speeds. As the size of these pumps increased, so did their weight. This required larger bearings and increased bearing loads and friction loses. As a result, larger pump motors were required.

Prior art pumps relying on centrifugal force usually operated at very high rotational speeds causing the pumped fluid to cavitate and erode the pump impeller.

The pumping apparatus of the present invention is an improvement over the prior art pumps. It uses the pumping fluid itself to carry the weight of the pump to minimize frictional losses and to eliminate the need for high weight carrying bearings Its rotating symmetrical pump mass allows it to operate at low rotational speed and yet generate sufficient centrifugal force and high torque to elevate large volumes of water to a high level continuously. As a result, only a small horsepower motor is required.

SUMMARY OF THE INVENTION

The pumping apparatus of the present invention comprises rotationally symmetric container adapted to float with its axis of rotation disposed vertically in a pump flotation chamber. An intake plenum in fluid communication with an intake or suction tube is located proximate the bottom end of the pumping apparatus. The bottom end of the intake or suction tube is immersed in an inlet reservoir. The rotationally symmetric container is provided with a plurality of conduits spiralling helically up its central chamber wall to an outlet end. A top air vent tube is attached to the central chamber cover plate concentric with the axis of rotation of the rotationally symmetric container. A main drive shaft connected to the rotationally symmetric container and having its longitudinal axis coincident with the axis of rotation of the rotationally symmetric container, extends from the bottom suction tube to beyond the top air vent tube. A bearing rod is journaled to the main drive shaft at its bottom end. A pump drive apparatus is connected to the main drive shaft proximate its top end. A fluid barrier is provided between the inlet reservoir and the flotation chamber. A ring of hinged plate valves is integrated within the helically spiraling conduits and is located proximate the bottom end. The buoyancy of the rotationally symmetric container is adjusted by letting water into its central chamber via DC relay controlled inlet valves located on the central chamber top cover and letting water out of its central chamber via DC relay controlled outlet valves located on the inside wall proximate the bottom of the container.

An overflow conduit is provided along the wall of the pump flotation chamber and extends from the surface of the water above the outlet end of the spiralling conduits through the bottom of the flotation chamber into the inlet reservoir.

It is, therefore, an object of the present invention to provide an apparatus for pumping fluids.

It is a further object of the present invention to provide a device for pumping fluids in which weight of the apparatus is carried by the fluid being pumped.

It is another object of the present invention to provide a device for pumping fluids that can be operated at relatively slow rotational speeds and requires a small horsepower motor.

It is a further object of the present invention to provide a device for pumping fluids to a higher elevation using helically spiralling conduits of simple design.

These and other objects of the present invention will become manifest upon study of the drawings taken together with the following specification and claims.

DESCRIPTION OF THE PREFERRED EMBODIMENT

Figure 1:
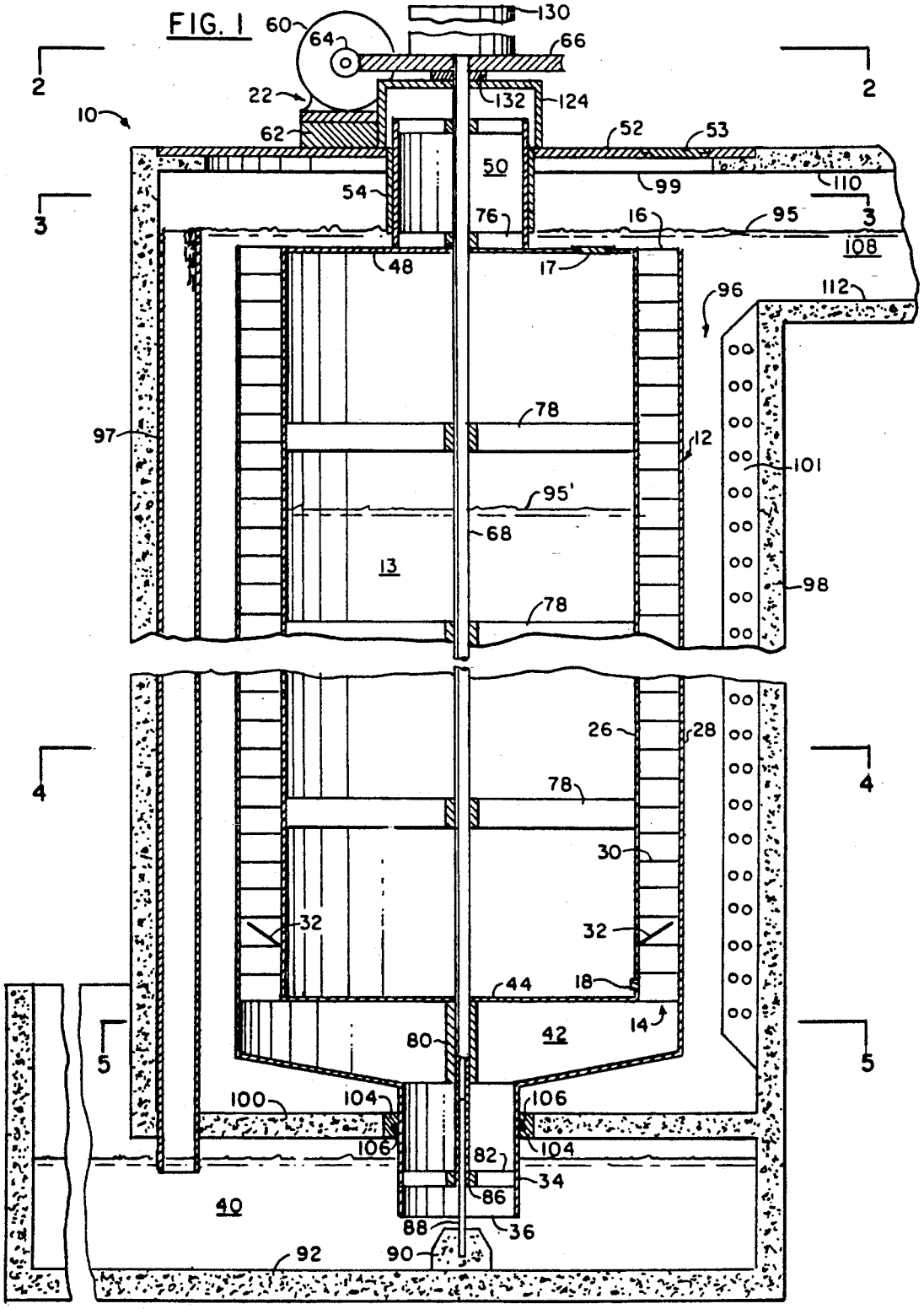
FIG. 1 is an elevational cross-section of the pumping apparatus of the present invention.

With reference to FIG. 1 there is illustrated an elevational cross section of fluid pump 10 of the present invention showing its general configuration and structure.

Fluid pump 10 of the present invention comprises, essentially, rotationally symmetric container 12 having an inlet end 14 proximate its lower end and an outlet end 16 proximate its upper end with its axis of rotation 20 disposed vertically. A pump drive apparatus 22 is connected proximate outlet end 16 to rotate rotationally symmetric container 12 about its axis of rotation 20.

At the center of rotationally symmetric container 12 is central chamber 13 which is defined by central chamber wall 26, central chamber cover 48, and intake plenum ceiling 44. Central chamber cover 48, defines an annular ring which contains inlet valves 17. The outer peripheral edge of central chamber cover 48 is attached to the top edge of central chamber wall 26. The inner edge of the annular ring is attached to top air vent tube or conduit 50 to allow air to flow in and out of the central chamber. Outlet valves 18 located on central chamber wall 26 proximate the bottom section. The axis of rotation of central chamber 13 is disposed coincident with axis of rotation 20 of rotationally symmetric container 12.

A plurality of helical conduits 30 spiral up the periphery of central chamber 13 between central chamber wall 26 and outside wall 28. A ring of hinged plate valves 32 is located in spiralling conduits 30 proximate the bottom section.

Inlet end 14 of rotationally symmetric container 12 comprises, essentially, a bottom suction tube 34 having its bottom opening 36 partially immersed in inlet reservoir 40 with its top opening connected to and in fluid communication with intake plenum 42. Intake plenum 42 is, in turn, connected to outer wall 28 proximate the bottom rotationally symmetric container 12 to provide fluid communication between helically spiralling conduits 30 and bottom suction tube 34. Intake plenum ceiling 44 is attached about its peripheral edge to central chamber wall 26 of central chamber 13 to make the interior of central chamber 13 water tight.

Outlet end 16 of rotationally symmetric container 12 comprises, essentially, central chamber annular ring plate or cover 48, top air vent tube or conduit 50 and the top section of helically spiralling conduits 30. Top air vent tube or conduit 50 is attached to central chamber cover 48 proximate the inner edge of the annular ring. The axis of rotation of top air vent tube or conduit 50 is disposed coincident with axis of rotation 20 of rotationally symmetric container 12. Top air vent tube or conduit 50 is adapted to penetrate pump top support platform 52. A top air vent tube guide 54 lines the opening in pump top support platform 52 to place axis of rotation 20 of rotationally symmetric container 12 in roughly the vertical position. Top air vent tube guide 54 also protrudes into the water below the surface to keep fluid from surging up into pump drive apparatus 22. When in operation, pump drive apparatus 22 will maintain the axis of rotation 20 of rotationally symmetric container 12 in the vertical position. The outside surface of top air vent tube or conduit 50 will thus be spaced a small clearance distance from top air vent tube guide 54 to avoid friction losses in the system.

Pump drive apparatus 22 comprises, essentially, pump drive motor 60 connected to pump drive mounting bracket 62 which is connected to pump top support platform 52. Pump drive motor 60 is provided with pump drive worm gear 64 which engages main pump drive gear 66. Main pump drive gear 66 is connected to main drive shaft 68 of rotationally symmetric container 12 through pump drive slope block overrunning clutch apparatus 70. In the present embodiment, main drive shaft 68 is round with its upper portion splined. Drive gear spline shaft 72 contains a round hole and allow main drive shaft to move up or down during operation of pump 10.

As main drive shaft 68 passes through fluid pump 10 it is attached, proximate its upper end to top air vent tube bracing spider 76, proximate its main central portion to internal bracing spiders 78, and proximate its lower end to intake plenum stiffener brackets 80 and suction tube bracing spider 82. Top air vent bracing spider 76, internal bracing spiders 78, intake plenum stiffener brackets 80 and suction tube bracing spider 82 are necessary to maintain the shape of structure because of its light weight construction and to transmit the torsional forces from pump drive apparatus 22 to rotationally symmetric container 12.

The bottom end of main drive shaft 68 is provided with a hole 86 coincident with its axis of rotation which is adapted to receive bottom bearing rod 88. Bottom bearing rod 88 is connected to bottom bearing support 90 which, in turn, is attached to inlet reservoir floor 92.

Figure 13:
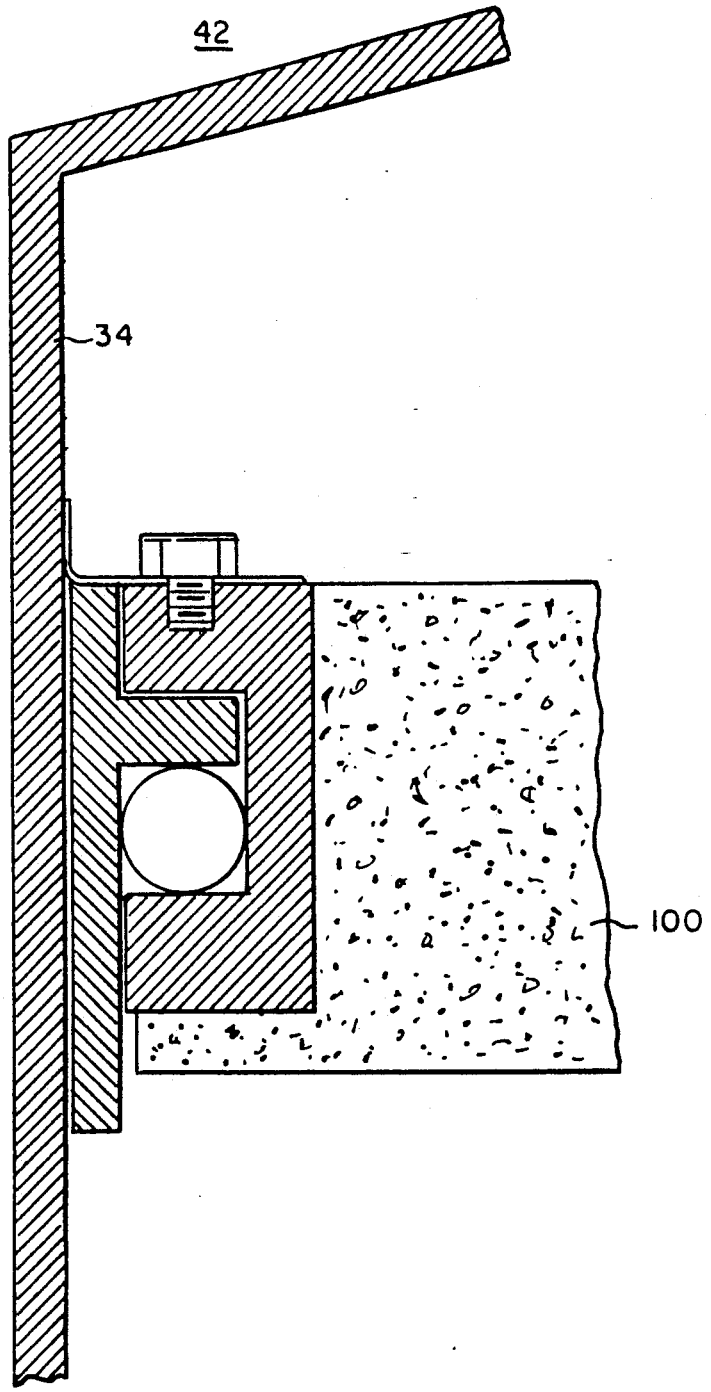
FIG. 13 is an elevational cross-section of a balling thrust bearing anti-friction device for the lower or suction end of the fluid pump of FIG. 1.

Rotationally symmetric container 12 including outlet end 16 and intake plenum 42 is contained in pump flotation chamber 96 defined by flotation chamber wall 98, inlet reservoir ceiling 100 and flotation chamber ceiling 99. An overflow conduit 97 is provided along one section of the pump flotation chamber wall 98 extending from the surface of water 95 above the top end of spiral conduits 30 to the bottom of chamber 96 and through inlet reservoir ceiling 100 into inlet reservoir 40. V-shaped perforated barriers 101 are provided along pump flotation chamber wall 98 to prevent fluid in chamber 96 from rotating with symmetric container 12 in order to maintain stability of water level and buoyancy. Inlet reservoir ceiling 100 combined with bottom suction tube bearing 104 and bottom suction tube O-ring seal 106 separate water contained in pump flotation chamber 96 from water contained in inlet reservoir 40. As an alternative, a balling thrust bearing anti-friction device, as shown in FIG. 13, can be used instead of bearing 104 and O-ring seal 106. An outlet tunnel 108 defined by outlet ceiling 110 and outlet floor 112 is provided for removal of the pumped fluid not returned to inlet reservoir 40 by overflow conduit 97.

Figure 2:
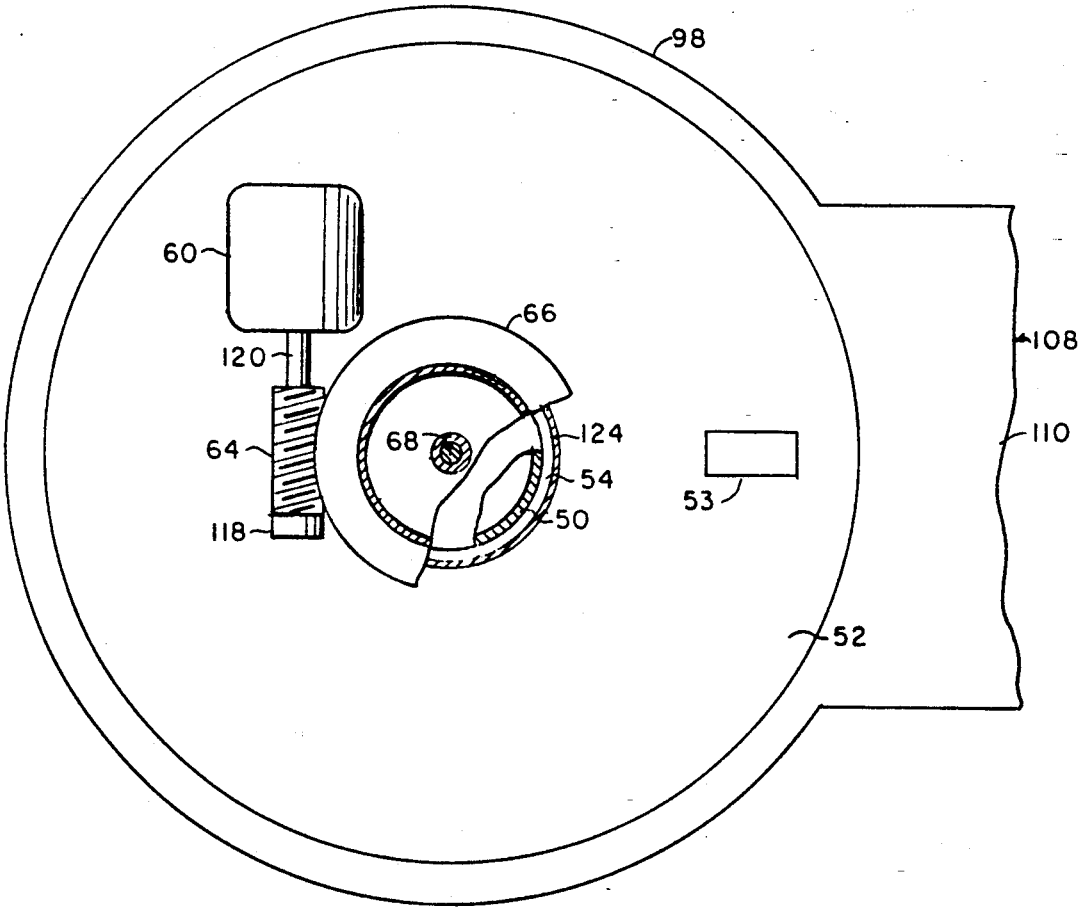
FIG. 2 is a top view of the pumping apparatus of the present invention taken at line 2—2 of FIG. 1.

With reference to FIG. 2 there is illustrated a top view of the fluid pumping apparatus 22 of the present invention taken at lines 2—2 of FIG. 1. Pump top support platform 52 is shown being supported by flotation chamber wall 98.

Mounted on pump top support platform 52 is pump drive motor 60 and pump drive motor shaft end bearing 118 journaled to pump drive motor shaft 120. Also mounted on pump top support platform 52 is slope block overrunning clutch assembly support 124. Slope block overrunning clutch assembly is connected both to slope block overrunning clutch assembly support 124 and main pump drive gear 66. Main pump drive gear 66 is adapted to engage both pump drive worm gear 64 connected to pump drive motor shaft 120 and bottom overrunning clutch block 136. Bottom overrunning clutch block 136, in turn, engages top overrunning clutch block 138 to apply torque to main drive shaft 68 thus causing rotationally symmetric container 12 to rotate.

Figure 3:
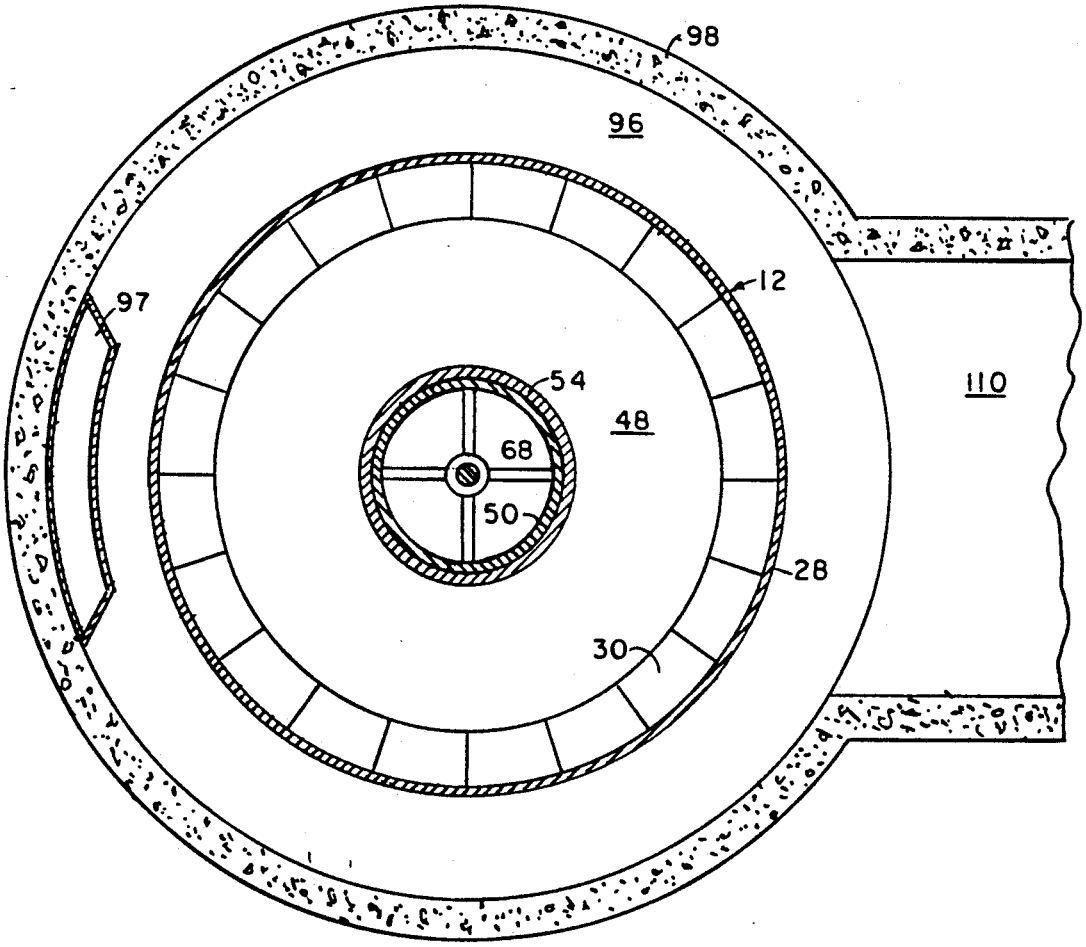
FIG. 3 is a horizontal section through the pumping apparatus of the present invention taken at lines 3—3 of FIG. 1.

With reference to FIG. 3, there is illustrated a horizontal cross-section of rotationally symmetric container 12 taken at lines 3—3 of FIG. 1. Main drive shaft 68 can be seen attached to top air vent bracing spider 76. Also shown in FIG. 3 is a top view of outlet end 16 showing the top openings of helically spiralling ducts or conduits 30. Outlet end annular ring air access plate 48 is also shown with its outer periphery attached to central chamber wall 26. The inner edge of outlet end annular ring access plate 48 is attached to the bottom lip of top air vent tube 50. Also shown in FIG. 3 is the top of overflow conduit 97.

Figure 4:
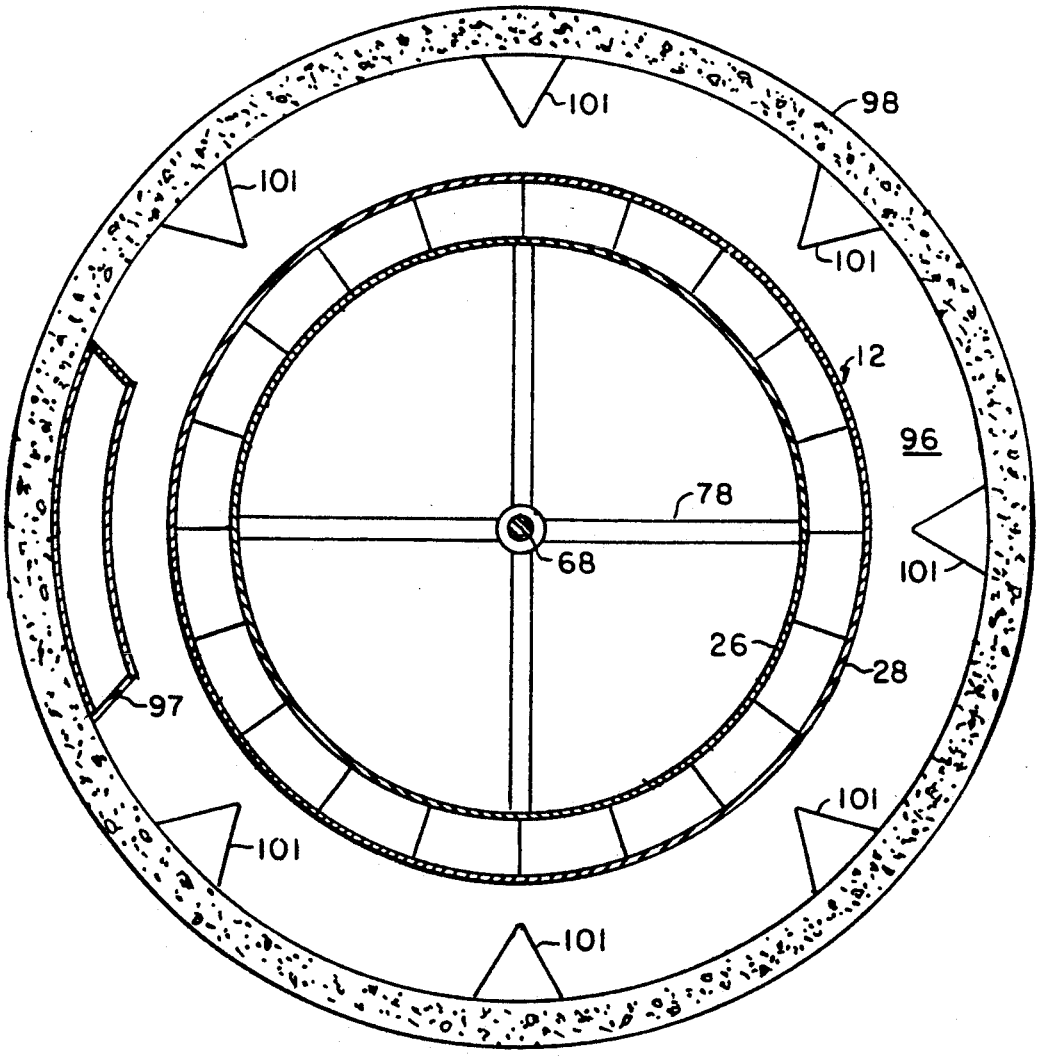
FIG. 4 is a horizontal section through the pumping apparatus of the present invention taken at lines 4—4 of FIG. 1.

With reference to FIG. 4, there is illustrated a horizontal cross section of rotationally symmetric container 12 taken at lines 4—4 of FIG. 1. Main drive shaft 68 can be seen attached to internal bracing spider 78. The ends of internal bracing spider 78 are in turn attached to rotationally symmetric container inner wall 26. V-shaped perforated fluid barriers 101 are shown attached to pump flotation chamber wall 98.

Also shown in FIG. 4 are sections through the plurality of helically spiralling ducts or conduits 30 disposed between rotationally symmetrical container inner and outer walls 26 and 28, respectively.

Figure 5:
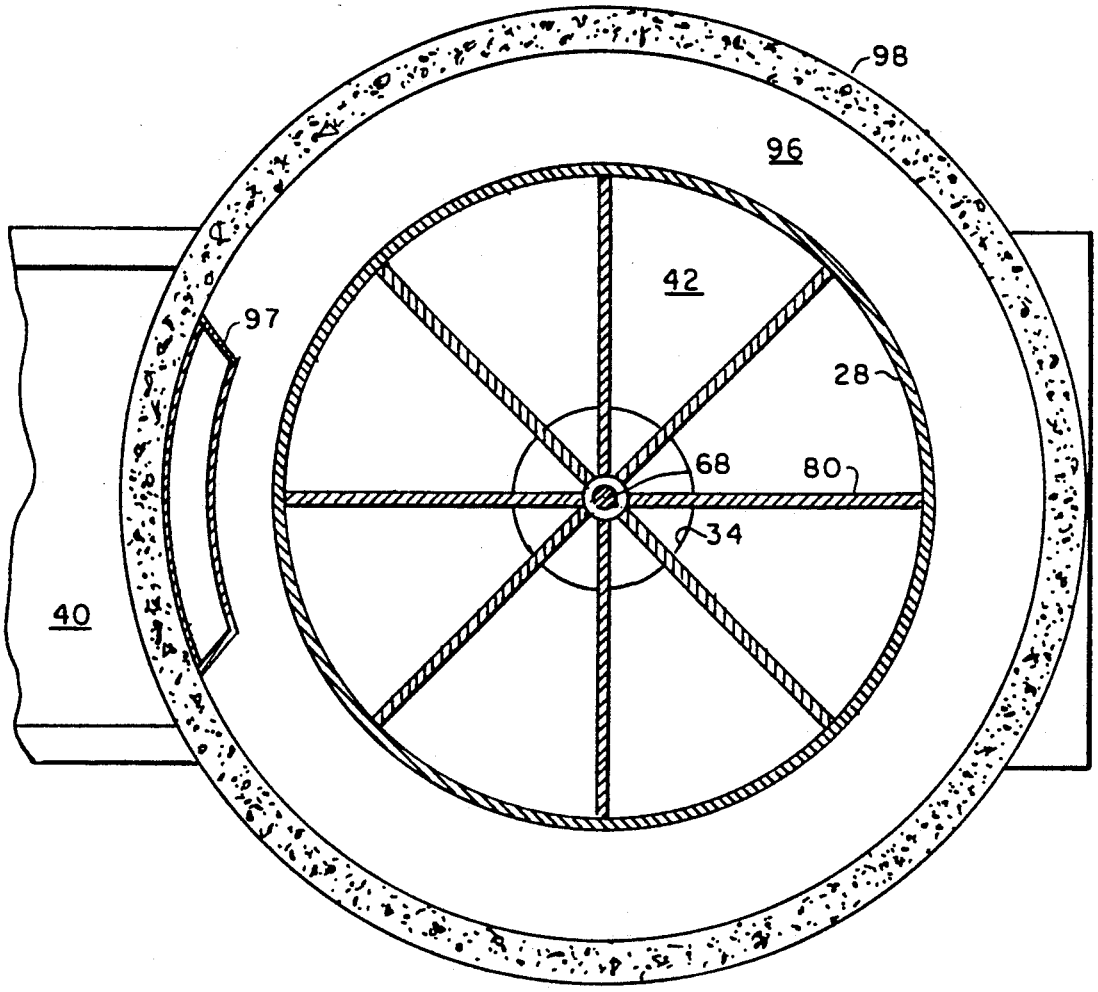
FIG. 5 is a horizontal section through the pumping apparatus of the present invention taken at lines 5—5 of FIG. 1.

With reference to FIG. 5, there is illustrated a horizontal cross-section of intake plenum 42 of inlet end 14 of rotationally symmetric container 12 taken at lines 5—5 of FIG. 1. FIG. 5 shows the manner in which main drive shaft 68 is attached to intake plenum stiffener brackets 80.

Figure 6:
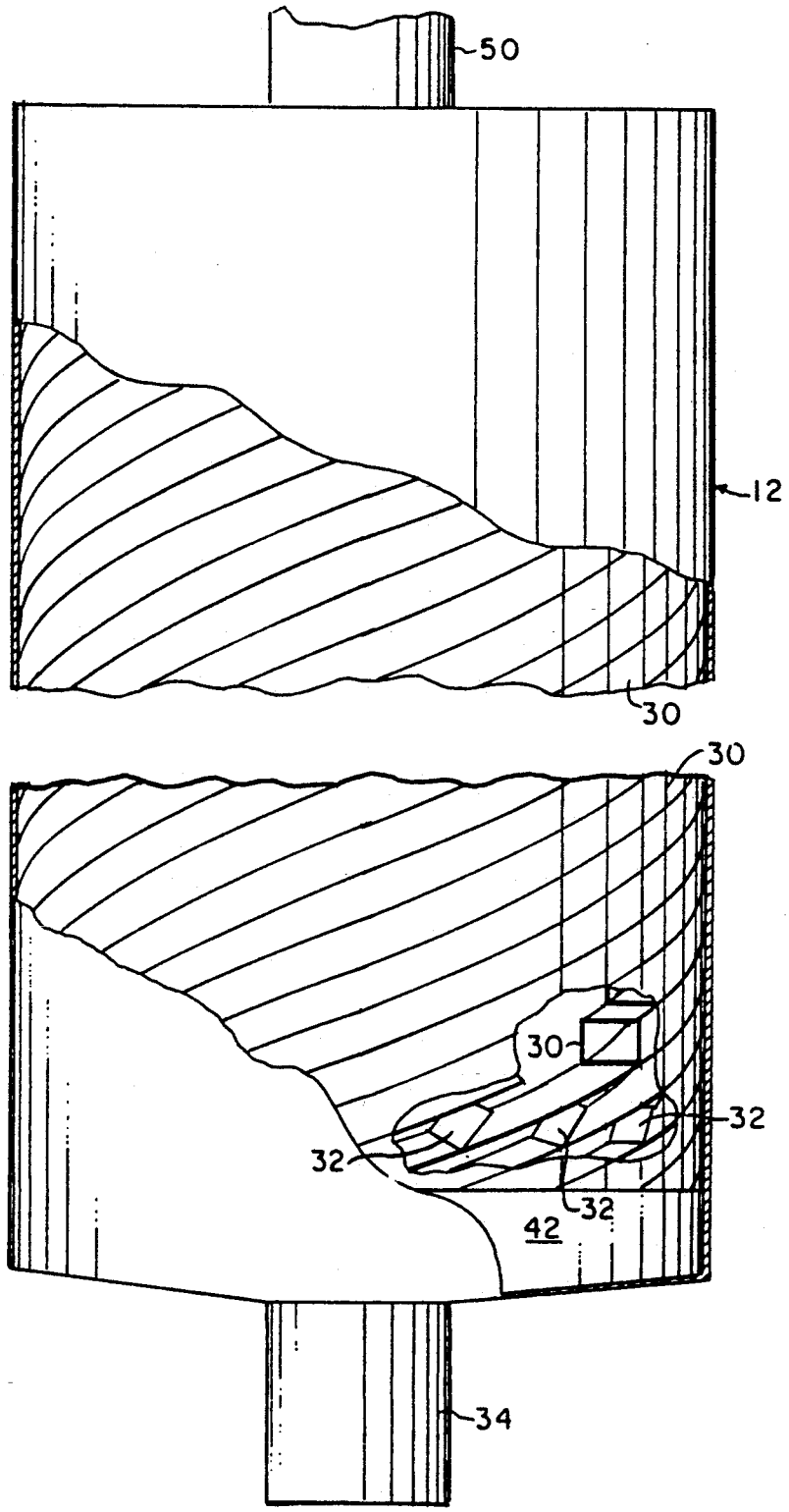
FIG. 6 is an elevation partial cut-away view of the pumping apparatus of the present inventions showing, in greater detail, the configuration of the helically spiralling conduits of the rotationally symmetric container shaped as a cylinder.

With reference to FIG. 6 there is illustrated an elevational view of rotationally symmetric container 12 with partial sections removed in order to more clearly illustrate the configuration of helically spiralling ducts or conduits 30. For the present embodiment, there are 24 helically ducts or conduits 30 set at an angle of approximately 22 degrees spiralling upwardly in a counterclockwise direction when viewed from the top. Also shown in FIG. 6 is the ring of hinged plate valves 32 located at the lower sections of helically spiralling conduits 30.

Figure 7:
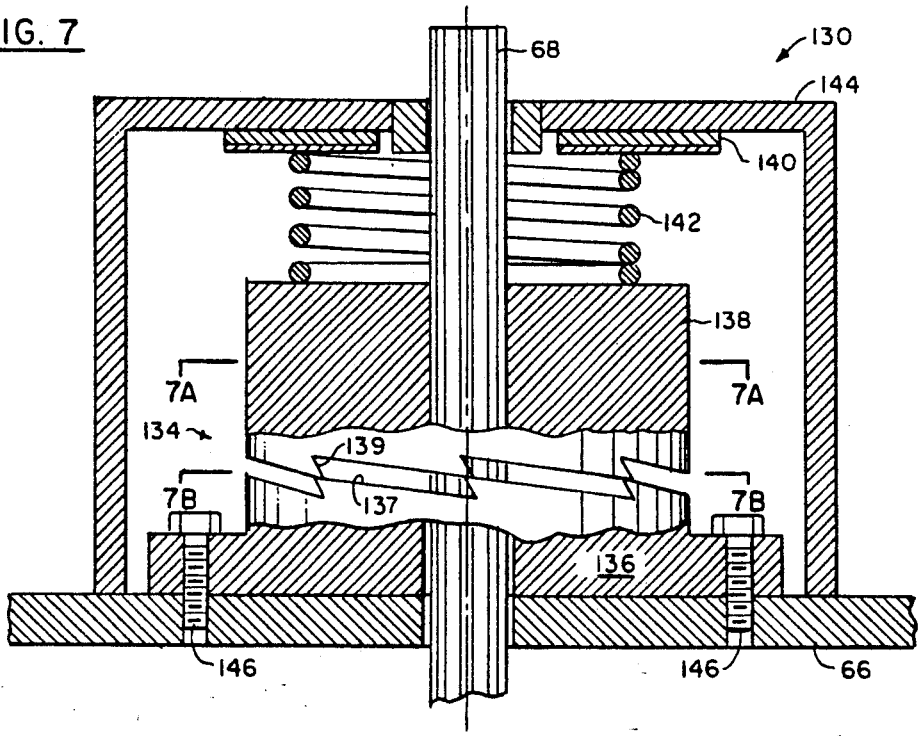
FIG. 7 is a detail drawing showing the pump drive apparatus in greater detail.

With reference to FIG. 7 there is illustrated a detail drawing showing slope block overrunning and clutch assembly 130 of pump drive apparatus 22 in greater detail. Thrust bearing and clutch assembly 130 comprises a thrust bearing 132 located between main drive gear 66 and the top of thrust bearing and clutch assembly support 124. Main drive clutch 134 is located on top of main drive gear 66.

Thrust bearing 132 comprises an upper annular ring bearing 150 attached to main drive gear 66 using upper thrust bearing bolts 156. Lower thrust bearing guide plate 152 is attached to the top surface of thrust bearing and clutch assembly support 124 by lower thrust bearing bolts 158. Since annular ring bearing 150 is in slidable contact with lower bearing plate 152, bolts 158 are recessed in lower bearing plate 152. Lower thrust bearing annular ring shaft 154, integrally incorporated in lower bearing plate 152, engages or is journaled to the inner hole of upper annular ring bearing 150. An anti-friction material, such as, lubricating grease or oil must be used between upper and lower bearing plates 150 and 152. A roller thrust bearing can be substituted for the above described thrust bearing 132 as shown in FIG. 15.

Main drive clutch 134 comprises a bottom overrunning clutch block 136, the input side of main drive clutch 134, and a top overrunning clutch block 138, the output side of main drive clutch 134, in slope mesh engagement with the top surface of bottom overrunning clutch block 136. Bottom overrunning clutch block 136 is attached to main drive gear 66 using bolts 146. Top overrunning clutch block 138 is attached to drive spline shaft 68. The upper section of main drive shaft 68 is splined and is slidably received in spline hole 141 of top overrunning clutch block 138. The output torque of top overrunning clutch block 138 is, therefore, used to rotate main drive shaft 68.

To increase the slope mesh engaging effect between top overrunning clutch block 138 and bottom overrunning clutch block 136, a clutch compression spring 142 is biased between top overrunning clutch block 138 and main drive clutch housing 144. A roller thrust bearing 140 is located between the top end of clutch compression spring 142 and the underside of main drive clutch housing 144 to allow clutch housing 144 to rotate relative to compression spring 142. Main drive clutch housing 144 is also attached to main drive gear 66 using bolts 148.

It can be seen that, during normal operation of fluid pump 10, main drive shaft 66 must transmit sufficient torque to rotate main drive shaft 68 and the attached rotationally symmetric container 12. When the heavy peripheral mass of rotationally symmetric container 12 causes fluid pump 10 to rotate faster than the designated normal operational speed, it causes top clutch block 138 to rotate faster or overrun bottom clutch block 136. This causes top clutch block 138 to slide up a little bit and top mesh gear teeth 139 to disengage from bottom mesh gear teeth 137. With the disengagement, main drive gear 66 can no longer transmit torque to rotate main drive shaft 68 which causes fluid pump 10 to gradually reduce its rate of rotation. As rate of rotation of fluid pump 10 reduces to be equal to or less than the designated normal speed, it causes top clutch block 138 to slow down and top mesh gear 139 to slide down and to engage with bottom mesh gear teeth 137. With the re-engagement, main drive gear 66 resumes torque transmission to rotate fluid pump 10.

Figure 8:
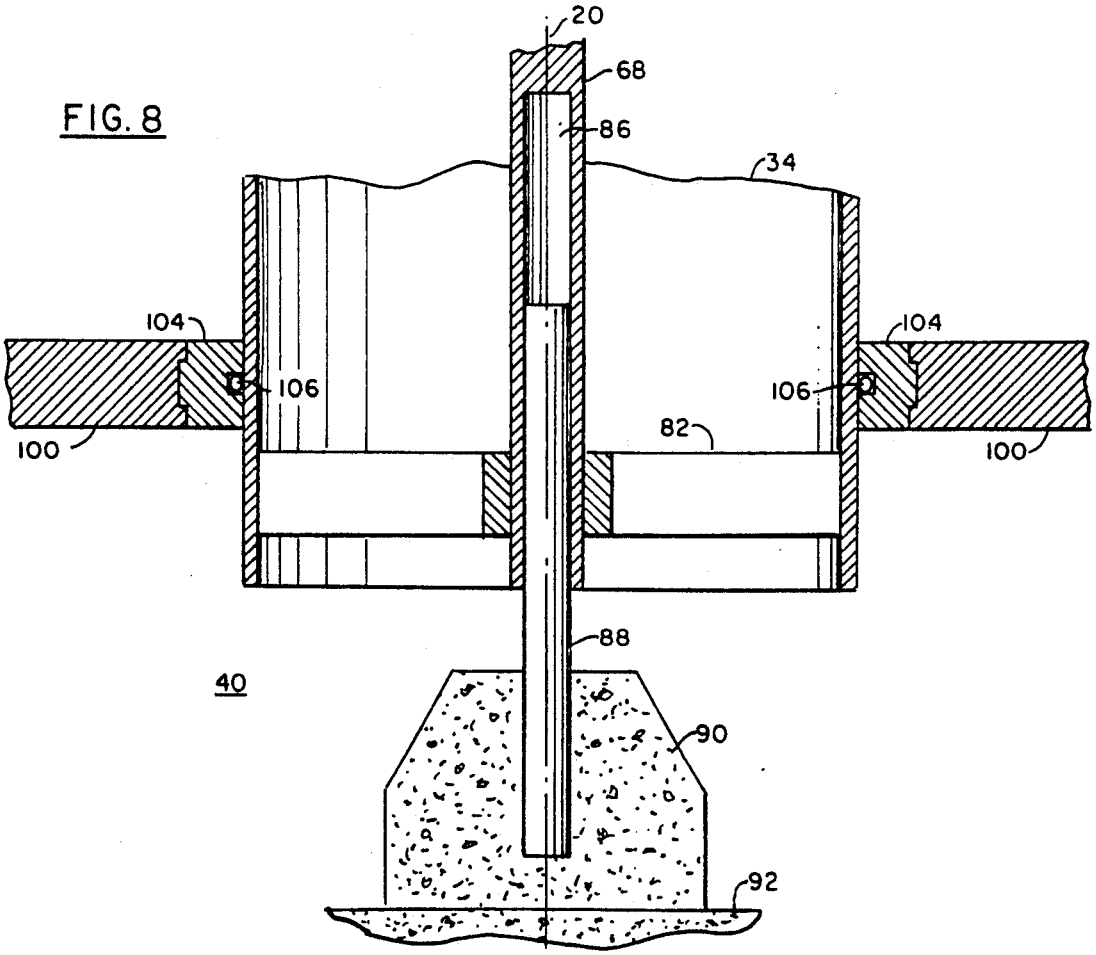
FIG. 8 is a detail drawing showing the bottom suction tube bearing and its method of sealing in greater detail.
Figure 7A:
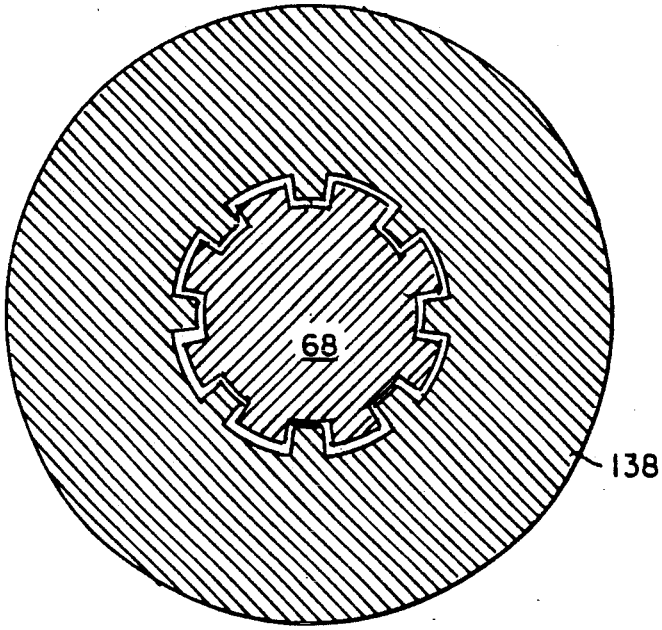
FIG. 7A is a horizontal section through the slope block clutch assembly taken at lines 7A—7A of FIG. 7.
Figure 7B:
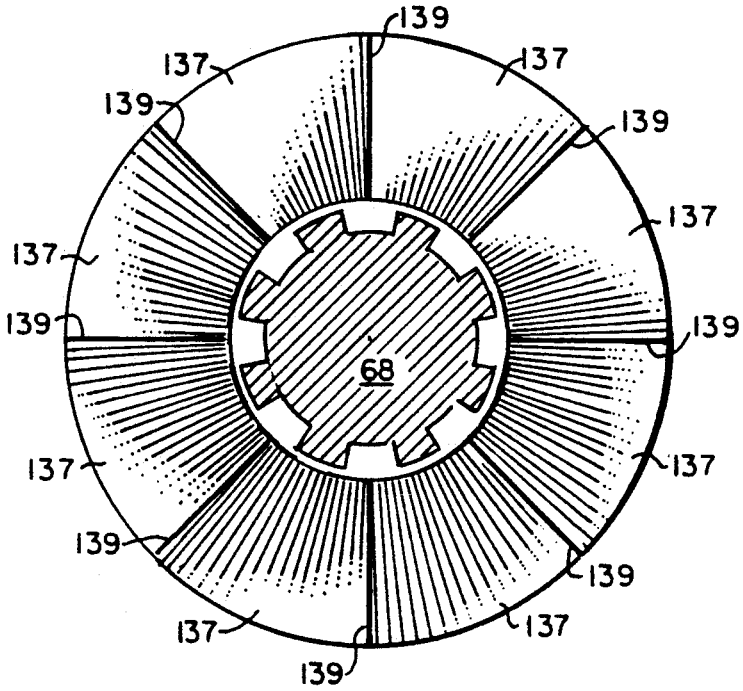
FIG. 7B is a horizontal section through the slope block clutch assembly of FIG. 7 taken at lines 7B—7B of FIG. 7.

With reference to FIG. 8 there is illustrated a detail drawing showing the bottom suction tube bearing 104 and its method of sealing in greater detail. Bottom bearing tube 104 comprises an annular ring member that is attached to inlet reservoir ceiling 100 by casting it in the concrete. The inner surface of bearing 104 is provided with a groove in which an O-ring seal 106 is placed before bottom suction tube is inserted in bearing 104. The inside diameter of bearing ring 104 is arranged to be slightly larger in diameter than the outside diameter of bottom suction tube 34. Thus O-ring seal 106 will allow bottom suction tube 34 to move vertically and also rotate in bottom suction tube bearing 104.

FIG. 8 also shows, in greater detail, bottom bearing rod 88 and the manner in which it is journaled to the bottom end of main drive shaft 68 using hole 86 therein. It can be seen that main drive shaft 68 is free to move up and down while still being journaled to rod 88.

Figure 9:
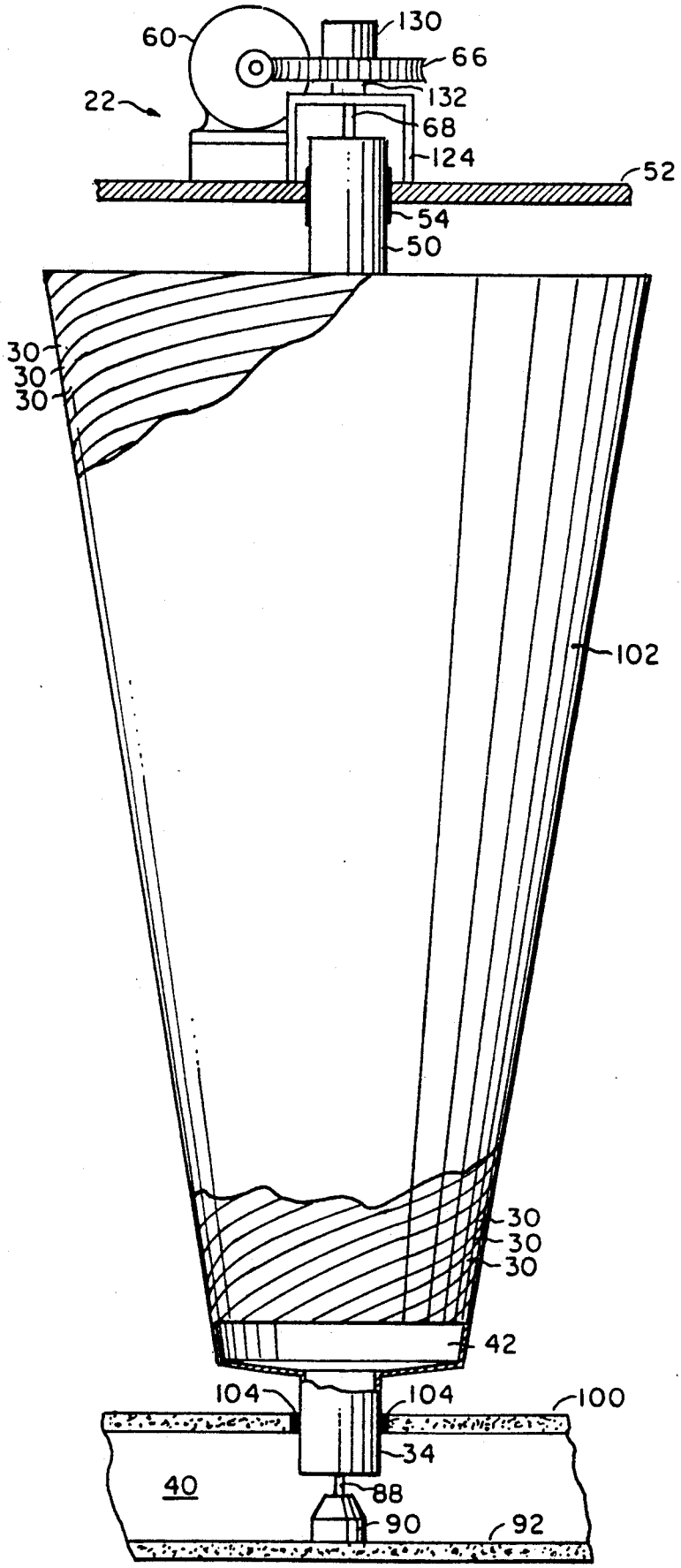
FIG. 9 is an elevation partial cut-away view of the pumping apparatus of the present inventions showing, in greater detail, the configuration of the helically spiralling conduits of the rotationally symmetric container shaped as a frusto-conical section.

With reference to FIG. 9 there is illustrated an elevation partial cut-away view of pumping apparatus 10 of the present inventions showing, in greater detail, the configuration of the helically spiralling conduits 30 of frusto-conical rotationally symmetric container 102. Frusto-conical rotationally symmetric container 102 is similar to cylindrical rotationally symmetric container 12 in that is designed to float in the fluid container in flotation chamber 96 but with greater buoyancy at the top or outlet end 16. Frusto-conical container 102 has the advantage of reducing horizontal unbalanced dynamic loads on bottom bearing rod 88 and bottom bearing support 90.

To assembly fluid pump apparatus 10 of the present invention, pump top support platform 52 is removed and rotationally symmetric container 12 is lowered, inlet end 14 first, into flotation chamber 96. Bottom suction tube or conduit 34 is aligned and inserted in bottom suction tube bearing 104 with bottom suction tube O-ring seal 106 in place and bottom bearing rod 88 connected to bottom bearing rod support 90. As bottom suction tube 34 is guided into bottom suction tube bearing 104, bottom bearing rod 88 is guided into the hole in the bottom end of main drive shaft 68.

Once in place, rotationally symmetric container 12 is maneuvered so that its axis of rotation 20 is vertical. Pump top support platform 52 is then lowered into position with top air vent tube guide 54 being also lowered around top air vent tube or conduit 50.

Thrust bearing support 124 is then connected to pump top support platform 52. Thrust bearing 132 is next installed on top of thrust bearing support 124 and main pump drive gear 66 is mounted on thrust bearing 132. Bottom overrunning clutch block 136, the input side of main drive clutch 134, is mounted to pump drive gear 66 using bolts 146. Top overrunning clutch block 138, the output side of main clutch 134, is lowered to engage the upper spline portion of main drive shaft 68. This also causes bottom mesh gear teeth 137 to engage with top mesh gear teeth 139. Finally, pump drive motor 60 is installed on pump drive mounting bracket 62 with worm gear 64 engaging main drive gear 66.

OPERATION

To operate the fluid pump apparatus of the present invention, rotationally symmetric container 12, pump flotation chamber 96, and inlet reservoir 40 are first simultaneously filled with the fluid that is being pumped such as water. Pump drive apparatus 22 is then energized to cause fluid pump 10 to rotate in fast acceleration to initiate upward motion of fluid in helically spiralling conduits 30. This would also initiate suction of fluid from inlet reservoir 40 into inlet end 14 of fluid pump 10.

As fluid begins to be pumped from inlet reservoir 40 and be discharged through outlet end 16, pump drive motor 60 is shifted to a lower gear to reduce the rate of rotation of rotationally symmetric container 12. At a relatively slow rate of rotation, the floating total mass of fluid pump 10 generates sufficient centrifugal force and high torque, as demonstrated by experimental models of fluid pump 10, to suck and push fluid upward continuously from inlet reservoir 40, through helically spiralling conduits 30 to outlet end 16 of rotationally symmetric container 12.

In the initial fluid filling process, pump flotation chamber 96, helically spiralling conduits 30, the bottom portion of central chamber 13, and inlet reservoir 40 are being simultaneously filled with the fluid that is being pumped. Filling these different compartments of fluid pump 10 simultaneously with fluid is essential to keep rotationally symmetric container 12 floating within designated levels throughout the entire filling process for protection of the fluid pump apparatus. As pump flotation chamber 96 is being filled with fluid via access tube or opening 53 located at pump top support platform 52, buoyancy of the fluid combined with the air pocket in central chamber 13 cause rotationally symmetric container 12 to rise slightly to the position shown in FIG. 1.

As flotation chamber 96 is being filled with more fluid, rotationally symmetric container 12 tends to rise higher than the designated level. This can cause outlet end 16 of fluid pump 10 to push against and eventually break pump top support platform 52 and pump drive apparatus 22 above it if not checked in time. To counter this detrimental effect, a proper amount of the same fluid is poured into central chamber 13 via top air vent tube or conduit 50 to increase the weight of fluid pump 10 and reduce the size of the air pocket in central chamber 13. This results in causing rotationally symmetric container 12 to sink slightly to within the proper level.

The upper sections of helically spiralling conduits 30 above the ring of hinged plate valves 32 are also filled completely to the top by pouring fluid into the top of the spiral duct that is located right underneath access tube or opening 53. The fluid flows down that particular spiral conduit to hinged plate valve 32 and then flows laterally to fill up the other spiral conduits 30.

The ring of hinged plate valves 32 contains uni-directional valves which allow fluid to flow from the lower section of helically spiralling ducts 30 beneath the ring of hinged plate valves 32 to the upper sections of helically spiralling conduits 30. During this filling process, the ring of hinged plate valves 32 holds the fluid in the upper sections of helically spiralling conduits 30.

At the completion of the fluid filling process, the surface of fluid 95 in pump flotation chamber 96 reaches a level as shown in FIG. 1. Overflow conduit 97 keeps the fluid at this level by letting additional fluid flow down overflow conduit 97 into inlet reservoir 40. At this stage, the top outlets of helically spiralling conduits 30, central chamber 48, and the bottom of top air vent tube guide 54 are all submerged below the surface of fluid 95. At this stage, rotationally symmetric container 12 contains two air pockets. One air pocket is situated in the upper portion of central chamber 13 above the fluid that has been poured into it. This air pocket keeps fluid pump 10 floating in flotation chamber 96.

The second air pocket is situated in the area defined by the sections of helically spiralling conduits 30 below the ring of hinged plate valves 32, inlet plenum 42, and bottom suction tube 34. This second air pocket will be forced out of rotationally symmetric container as fluid pump 10 rotates in acceleration during the startup process in order to create a complete vacuum in the pumping chamber.

To fill inlet reservoir 40, additional fluid is poured into pump flotation chamber 96 to cause fluid to overflow into overflow conduit 97 and into inlet reservoir 40. Inlet reservoir 40 should contain enough fluid to replace the volume defined by the second air pocket in rotationally symmetric container 12 and for addition to central chamber 13 for flotation level adjustment of rotationally symmetric container 12.

To start up fluid pump 10, pump drive motor 60 is energized causing pump drive worm gear 64 to rotate main pump drive gear 66 and rotationally symmetric container 12 in a clockwise direction when viewed from the top. As rotationally symmetric container 12 starts to rotate in the fluid in pump flotation chamber 96, pump drive motor 60 is shifted into higher gear to accelerate the rotation of rotationally symmetric container 12. As rotationally symmetric container 12 rotates in fast acceleration, the fluid contained in helically spiralling conduits 30 starts to move upward rapidly which creates a strong suction force to suck the air of the second air pocket below the ring of hinged plate valves 32 out of helically spiralling conduits 30. This strong suction force then pulls fluid from inlet reservoir 40 up through intake plenum 42, helically spiralling conduits 30, and discharges it through outlet end 16 of rotationally symmetric container 12 into the fluid above the outlet ends of helically spiralling conduits 30. The fluid above conduit 30 outlets would absorb the force of the discharge of fluid shooting out of the top openings of helically spiralling conduits 30.

After the second air pocket has been forced out of helically spiralling conduits 30, pump drive motor 60 is shifted to a lower gear to allow rotationally symmetric container 12 to decelerate down to a much slower rate of rotation for normal operation of fluid pump 10.

During normal operation of fluid pump 10, rotationally symmetric container 12 continues to rotate at a relatively slow rate of rotation in a clockwise direction when view from the top. The rate of rotation depends upon the size of the container such that the larger the diameter the slower the rate of rotation. The rate of rotation for a fluid pump that is 10 feet in diameter and 51 feet tall is approximately 40 revolutions per minute.

Fluid pumps of smaller diameter should keep the rate of rotation less than 60 revolutions per minute. At this relatively slow rate of rotation, it is essentially the heavy peripheral mass of rotationally symmetric container 12 which generates the required centrifugal force to push fluid upward rapidly and continuously. The peripheral mass is defined as the combined weights of central chamber wall 26, helically spiralling conduits 30, the fluid that is contained in helically spiralling conduits 30 and outer wall 28 of rotationally symmetric container 12. The heavy mass of rotationally symmetric container 12, when rotating in fluid, also results in generating enormous torque to overcome the relatively small sliding friction between the fluid and outer wall 28 and the sliding friction between the fluid and the walls of helically spiralling conduits 30.

As rotationally symmetric container 12 rotates, central chamber inlet valves 17 and outlet valve 18 are used to keep rotationally symmetric container 12 floating within designated limits. It rotationally symmetric container 12 is floating too high, central chamber inlet valves 17 would be opened to let fluid into central chamber 13. The heavier central chamber 13 adds weight to rotationally symmetric container 12 and lowers its level. If rotationally symmetric container 12 is floating too low, central chamber outlet valves 18 are opened to spin fluid out of central chamber 13 to reduce its weight and cause it to rise.

As rotationally symmetric container 12 floats up and down in the fluid contained in flotation chamber 96, main drive shaft 68 also slides up and down through main drive gear 66 and thrust bearing and clutch assembly 70 at the top, and slides up and down over bearing rod 88 at the bottom.

PROTOTYPE MODEL

Figure 1A:
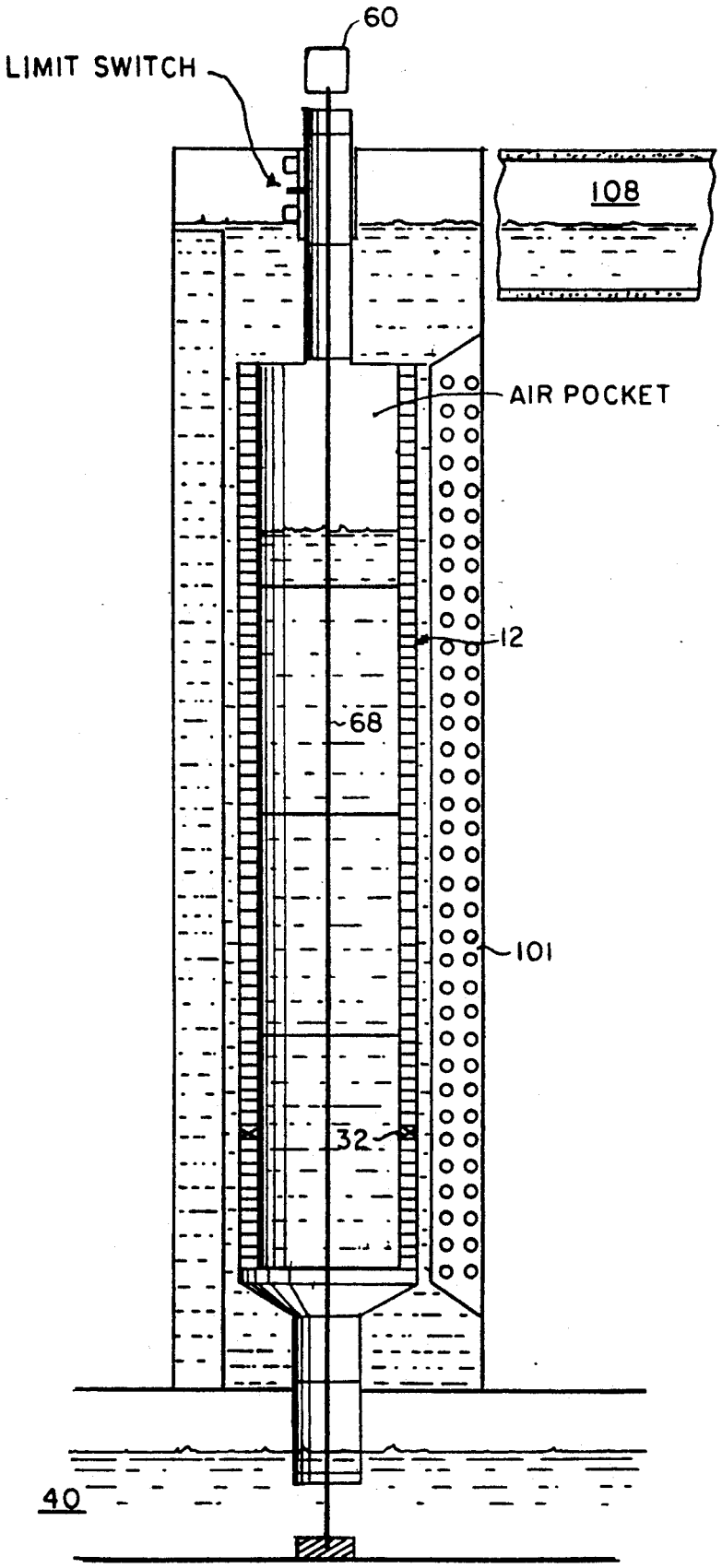
FIG. 1A is an elevational cross-section of a prototype pumping apparatus with approximate dimensions.

With reference to FIG. 1A, the dimensions of fluid pump 10 can vary depending upon the amount of fluid to be elevated as required by specific applications. The amount of fluid to be elevated is dependent upon the length of fluid pump 10 and its rate of rotation. The length of fluid pump 10 is generally derived from the diameter of rotationally symmetric container 12, the incline angle of helically spiralling conduits 30, and the number of pitches, i.e., turns, the spiral conduits make winding around central chamber 13 from top to bottom. Where 4-pitches are optional, 3-pitches are for special use, and a 5-pitches to 6-pitches are for extra long fluid pumps.

Table 1 is a list of approximate measurements of a prototype pump shown in FIG. 1A.

TABLE 1

| | |
|---|---|
| Rotationally symmetric container 12: | |
| Diameter | = 100 cm |
| Height | = 510 cm |
| Central Chamber 13: | |
| Diameter | = 80 cm |
| Height | = 510 cm |
| Helically Spiralling Conduits 30: | |
| Number of Conduits | = 24 |
| Number of Pitches | = 4 |
| Cross-section Dimension | = 10 cm × 10 cm |
| Incline Angle | = 22 degrees |
| Intake Plenum 42: | |
| Top Diameter | = 100 cm |
| Bottom Diameter | = 35 cm |
| Height | = 20 cm |
| Bottom Suction Tube 34: | |
| Diameter | = 35 cm |
| Height | = 100 cm |
| Top Air Tube or Conduit 50: | |
| Diameter | = 25 cm |
| Height | = 65 cm |
| Pump Flotation Chamber 96: | |
| Diameter | = 180 cm |
| Height | = 700 cm |

EXPERIMENTAL MODEL

An experimental model (210) of fluid pump 10 has been built and successfully demonstrated (on Jun. 21, 1991). Using a rotationally symmetric container similar to that described above the experimental model pumped water from a lower elevation to a higher elevation.

Figure 10:
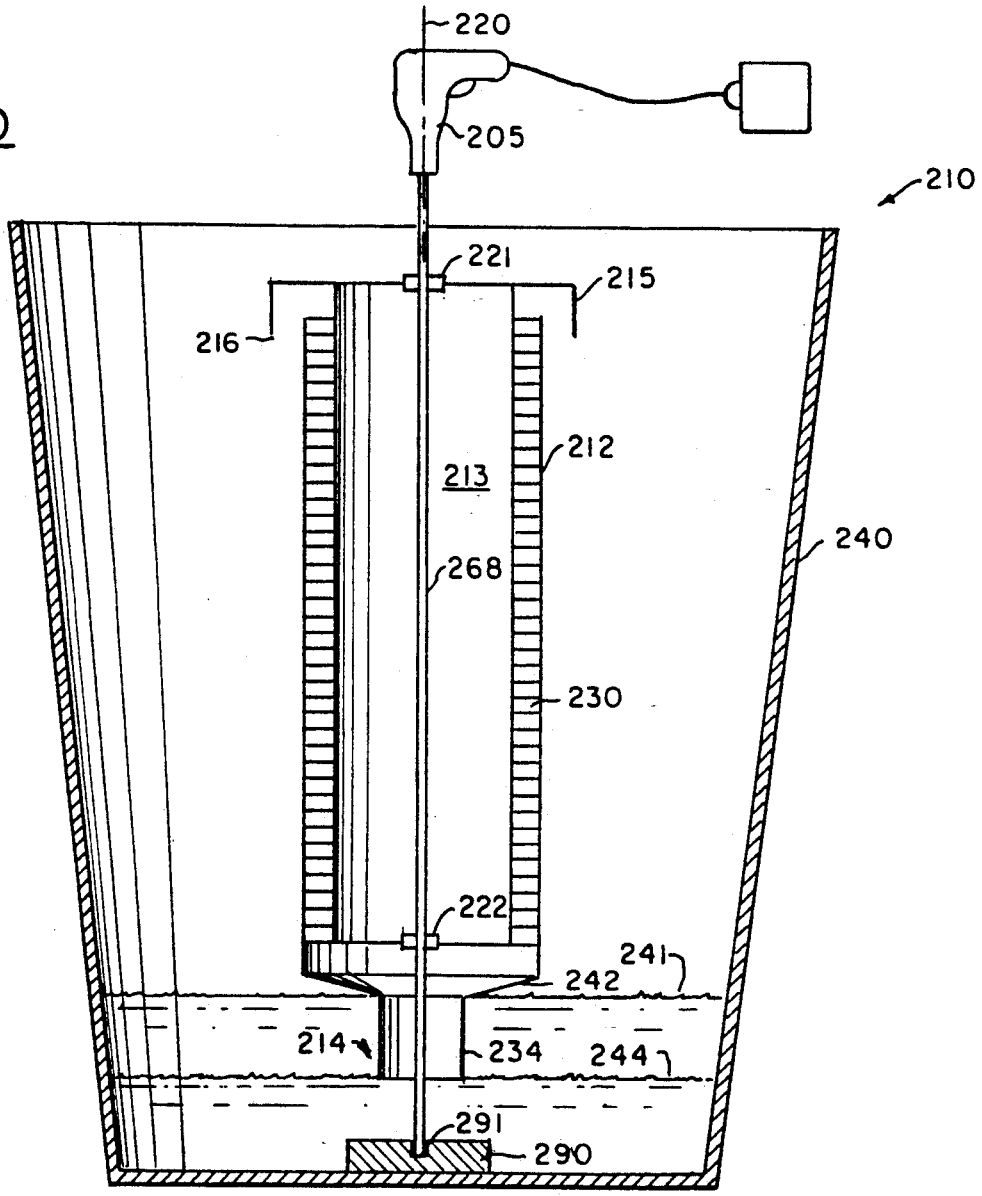
FIG. 10 is an elevational cross-section of the pumping apparatus of the experimental model.

With reference to FIG. 10, the configuration of experimental model 210 was as specified for rotationally symmetric container 12 described above. However, the size of experimental model 210 was about 28 times smaller than the size of a full scale fluid pump 10. Rotationally symmetric container 212 of experimental model 210 was 50.8 cm long and 17.8 cm in diameter. There were eight spiralling conduits 230 wound two pitches around central chamber 213. The rectangular cross-section of each spirally wound conduit measured approximately 1.27 cm by 1.90 cm.

A plastic container 240 was used as inlet reservoir 40. A bottom support wood block 290 with a metal reinforced 291 was used as bottom support bearing 90. An electric motor 205 was used to rotate experimental container 212 in a manner to prove the principle of operation of the pump of the present invention.

Flotation chamber 96, central chamber inlet valve 17 and outlet valve 18 were not included in the small scale model. The ring of hinged plate valves 32 used to restrain the water head in helically spiralling conduits 230 were also not included. It can be seen, however, such elements are not needed to demonstrate proof of the process. A top cap 215 was added to experimental model 210 to deflect the exiting jets of water back into the reservoir from which the water was being pumped.

Rotationally symmetric container 212 was connected to the main drive shaft 268 by tightening top annular mounting nuts 221 on the top and bottom of top cap 215. Intake plenum 242 was connected to main drive shaft 268 by tightening bottom annular mounting nuts 222 on the top and bottom of the cover of intake plenum 242.

Bottom suction tube 234 was welded to the bottom of intake plenum 242. Duct tape was used to wrap around the outer wall of the bottom section of rotationally symmetric container 212 to connect container 212 to intake plenum 242 for the purpose of preventing air from entering spiral conduits 230 through these joints. Water was used as the fluid being pumped.

Figure 14:
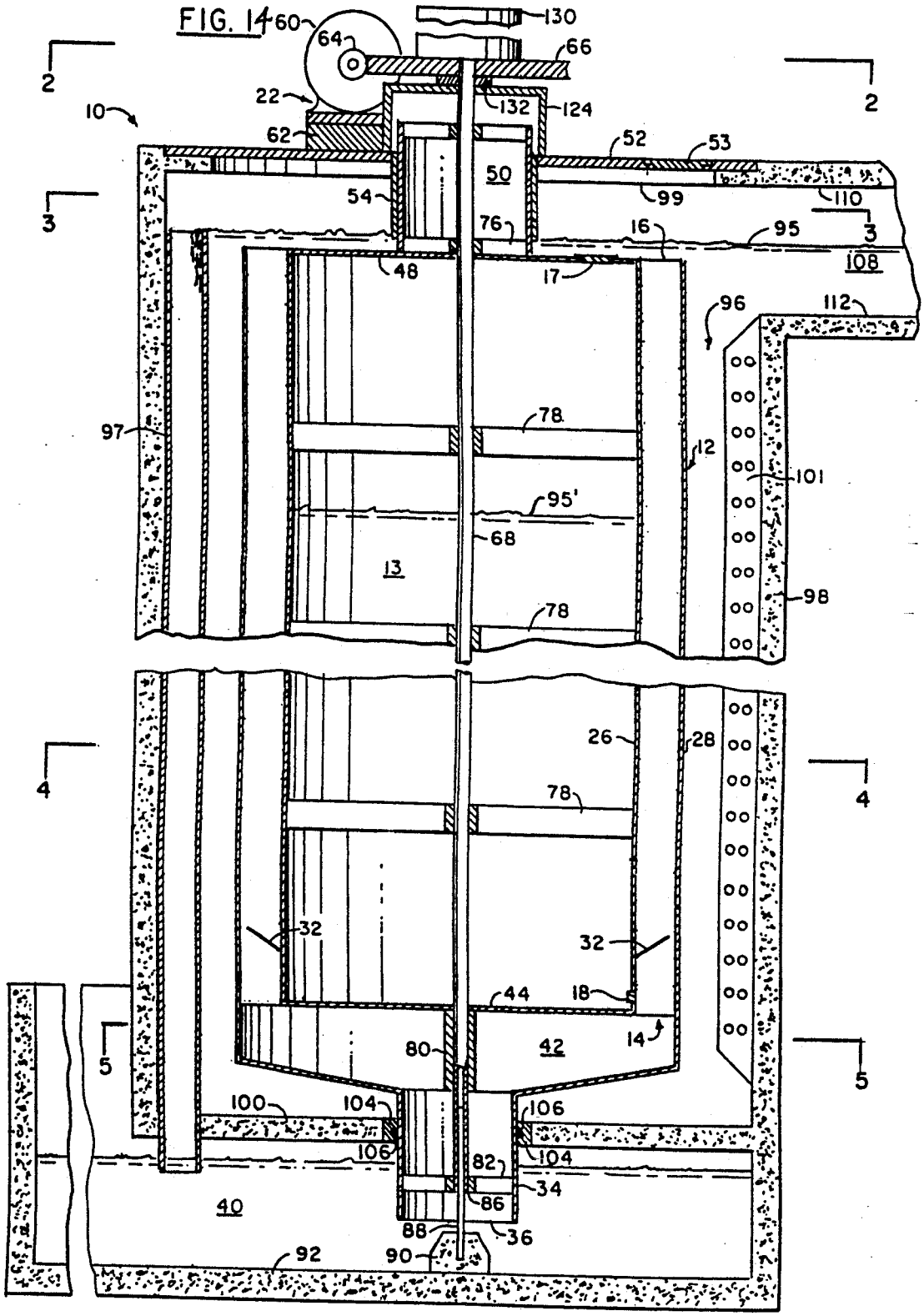
FIG. 14 is an elevational cross-section of the pumping apparatus of the present invention similar to that of FIG. 1 except that the spiraling conduits in FIG. 1 are not present in FIG. 14.

To operate experimental fluid pump 210, rotationally symmetric container 212 was placed inside inlet reservoir 240 by inserting the bottom of main drive shaft 268 into the metal reinforced hole or bearing 291 in bottom support block 290. FIG. 14 is an elevational cross-sectional of the pumping apparatus of the present invention similar to that of FIG. 1 except that the spiraling conduits helically proximate the outer periphery of the container in FIG. 1 have been omitted. Inlet reservoir 240 was then filled with water at a level 241 up to the bottom of intake plenum 242 as shown in FIG. 10. The volume of water between water level 244 and 241 was the only water to be pumped and to be circulated through fluid pump 210 during its experimental use.

An electric motor in the form of an electric drill 205 was connected to the top of main drive shaft 268. Rotationally symmetric container 212 was manually held in the vertical position with its main drive shaft 268 coincident with axis of rotation 220 and held in that position for the duration of the demonstration.

Electric drill 205 was turned on at normal speed to start rotation of rotationally symmetric container 212 in a clockwise direction when viewed from the top. After a few second, electric drill 205 was shifted to high speed to accelerate pump rotation. As rotationally symmetric container 212 was accelerated to a rate of about 120 revolutions per minute, water was lifted from inlet reservoir 240 and forcefully ejected from the top of rotationally symmetric container 212. The jets of water were deflected horizontally by top cap 215 to be again deflected by the wall of inlet reservoir 240 back to the reservoir of water contained in the bottom of reservoir 240.

It can be seen that the air pocket which was initially contained in helically spiralling conduits 230 was forced out of conduits 230 by the upward force of water during initial acceleration of rotationally symmetric container 212. After initial rotational acceleration, the rotational rate was reduced to 80 revolutions per minute by reducing the speed of electric drill 205. At 80 revolutions per minute water was discharged forcefully and continuously from the top of rotationally symmetric container 212.

There were 9 cm of water available for pumping as measured from water level 244 at the bottom of suction tube 234 to water surface 241. At 80 revolutions per minute, the 9 cm of water were pumped through helically spiralling conduits 230 in about 5 seconds. This was measured by discharging the pumped water outside reservoir 240 instead of returning it to the bottom or reservoir 240 for reuse. Rotationally symmetric container 212 was maintained at 80 revolutions per minute for the 3 minute duration of the test. Further experimentation found the minimum rotation rate for pumping water by experimental model 210 was 30 revolutions per minute. The above tests were repeated 50 times and it was found that the optimum rotation rate for experimental model 210 was 80 revolutions per minute.

Table 2 is a tabulation of the dimensions of experimental model 210.

TABLE 2

| | |
|---|---|
| Rotationally Symmetric Container 212: | |
| Diameter | = 17.8 cm |
| Height | = 50.8 cm |
| Helically Spiralling Conduits 230: | |
| Number of Conduits | = 8 |
| Conduit Cross Section Dimensions | = 1.27 cm × 1.9 cm |
| Number of Pitches | = 2 |
| Intake Plenum 242: | |
| Plenum Top Diameter | = 17.8 cm |
| Plenum Bottom Diameter | = 7.6 cm |
| Height Between Top and Bottom | = 4.4 cm |
| Bottom Suction Tube 234: | |
| Diameter | = 7.6 cm |
| Height | = 8.2 cm |
| Top Cap 215: | |
| Diameter | = 24 cm |
| Height | = 5.1 cm |

WATER CONVEYOR SYSTEM CONFIGURATION

Figure 11:
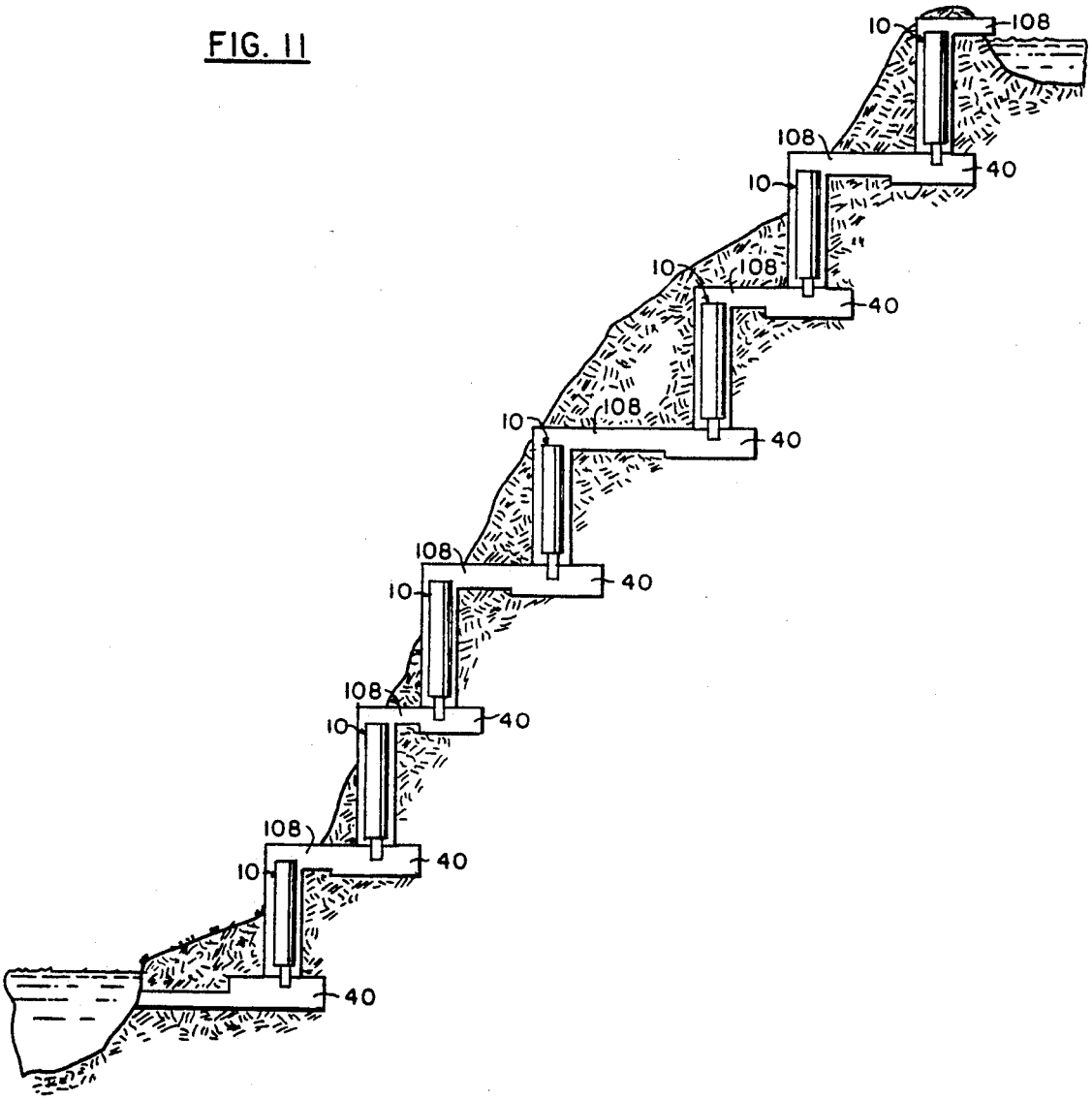
FIG. 11 is a diagrammatic drawing showing multiple fluid pumps serially connected and fluidly communicating with each other along a mountain slope.
Figure 12A:
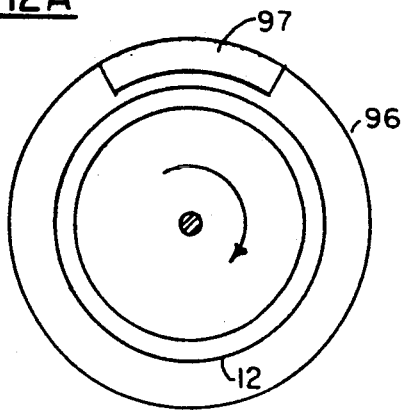
FIG. 12A is a diagrammatic drawing showing various configurations of the fluid pump for the water conveyor system using a single rotationally symmetric container configuration.
Figure 12B:
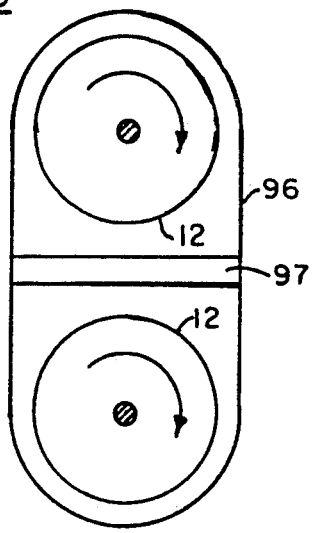
FIG. 12B is diagrammatic drawing showing various configurations of the fluid pump for the water conveyor system using two-rotationally symmetric container configuration.
Figure 12C:
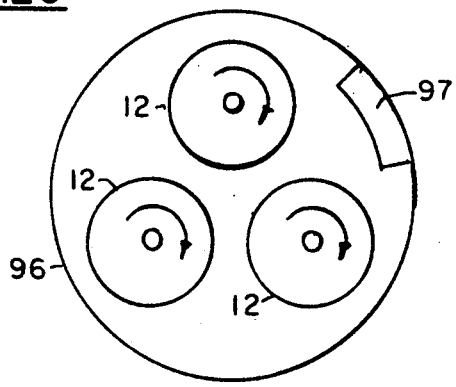
FIG. 12C is a diagrammatic drawing showing various configurations of the fluid pump for the water conveyor system using a three-rotationally symmetric container configuration.
Figure 12D:
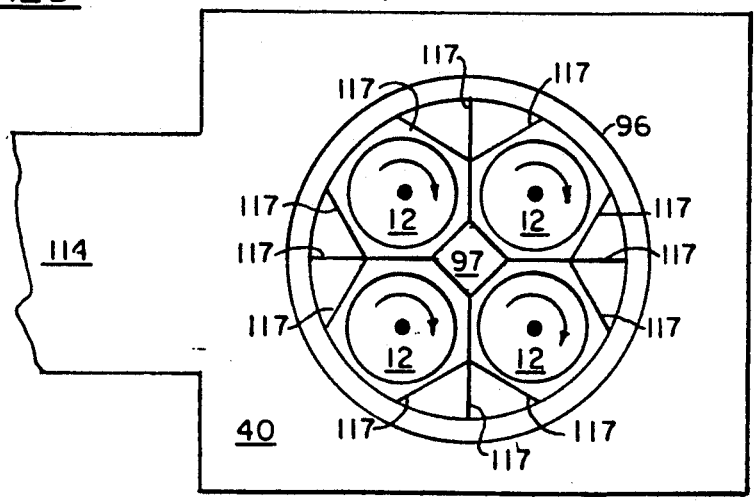
FIG. 12D is a diagrammatic drawing showing various configurations of the fluid pump for the water conveyor system using a four-rotationally symmetric container configuration.

With reference to FIG. 11, the water column conveyor system illustrated comprises multiple fluid pumps 10 of the present invention serially fluidly communicating with each other up the side of a mountain. The purpose of such a system is to pump water from a river or lake proximate the foot of the mountain and elevate up to storage facilities on top or further up the side of the mountain. Elevated water can be then conveyed over undulating land and mountains ranges to remote interior areas for irrigation, urban city water supply and hydroelectric power generation. As shown in FIG. 1, the pump used in the water conveyor system is fluid pump 10 described above, with the addition of outlet tunnel 108.

As shown in FIG. 11, the water column conveyor system comprises multiple fluid pumps 10, typical to that shown in FIG. 1, serially communicating with each other along the mountain slope from the water source at the bottom of the mountain. These fluid pumps 10 are serially communicating with each other by fluidly connecting outlet tunnels 108 of pump flotation chamber 96 to inlet reservoirs 40.

The operation of each fluid pump 10 in the water column conveyor system is identical to the operation of fluid pump 10 described above for a single pump. As the water is elevated from inlet end 14 to outlet end 16 of the lower fluid pump, it floats through outlet tunnel 108 of the lower fluid pump and into inlet reservoir 40 of the upper fluid pump. In this manner, water is being elevated continuously from the lower fluid pump to the upper fluid pump until it reaches the top of the mountain.

To increase the volume of water being elevated, fluid pump 10 can contain a plurality rotationally symmetric containers 12, as shown in FIGS. 12A, 12B, 12C, and 12D.

It can be seen that other configurations of the above-described apparatus can be made and, therefore, applicant intends that the apparatus be limited only by the following claims.

What is claimed is:

1. A fluid pump comprising an inlet reservoir for holding a fluid to be pumped, a pump flotation chamber for holding a volume of fluid, a rotationally symmetric container having an axis of rotation, an inlet end and an outlet end, said rotationally symmetric container floating with its axis of rotation disposed substantially vertically in said fluid contained in said pump flotation chamber, at least one conduit spiralling helically from said inlet end to said outlet end proximate the periphery of said rotationally symmetric container, and means for rotating said rotationally symmetric container in a direction to cause said fluid to flow upwardly in said conduit spiralling helically from said inlet end to said outlet end of said rotationally symmetric container and be discharged therefrom.

2. The fluid pump of claim 1, further comprising a bottom suction tube in communication with said fluid in said inlet reservoir and for communication with said inlet end of said rotationally symmetric container.

3. The fluid pump as claimed in claim 2, further comprising:

a suction conduit in fluid communication with said bottom suction tube, and a fluid tight intake plenum connected proximate the bottom end of said rotationally symmetric container and fluidly communicating said suction conduit with the bottom ends of said at least one helically spiralling conduit.

4. A fluid pump comprising:

an inlet reservoir for holding a volume of fluid, a pump flotation chamber for holding a volume of fluid, a rotationally symmetric container having an inlet end and an outlet end, said rotationally symmetric container floating with its axis of rotation disposed vertically in said fluid contained in said pump flotation chamber, at least one channel spiralling helically from said inlet end to said outlet end proximate the periphery of said rotationally symmetric container, and means for rotating said rotationally symmetric container in a direction to cause said fluid to flow upwardly in said channel spiralling helically from said inlet end to said outlet end of said rotationally symmetric container and be discharged therefrom.

5. The fluid pump of claim 4, said pump comprising a plurality of channels spiralling helically from said inlet end to said outlet end proximate the periphery of said rotationally symmetric container.

6. The fluid pump of claim 4, said container being a cylinder.

7. The fluid pump of claim 4, said container being frusto-conical in shape.

8. The fluid pump of claim 4, further comprising at least one peripheral ring of hinged plate valve that permits fluid flow upward but not downward through said channel.

9. The fluid pump of claim 4, further comprising a top air vent tube connected to the container to permit passage of air to and from the container.

10. The fluid pump of claim 4, said rotationally symmetric container defining a central chamber therein, said container having an inlet valve controlling flow of fluid into the central chamber and an outlet valve controlling flow of fluid from the central chamber, in order to regulate the flotation level of the container in said pump flotation chamber.

11. The fluid pump of claim 10, wherein said inlet valve controls the flow of fluid from the flotation chamber into the central chamber, and wherein said outlet valve controls the flow of fluid from the central chamber into the at least one channel.

12. A device for use in pumping fluid, comprising:

a rotationally symmetric container having an inlet end and an outlet end and an axis of rotation, said rotationally symmetric container adapted to float in a fluid with said axis disposed in a upright direction, and at least one channel suitable for conveying fluid from said inlet end to said outlet end proximate the periphery of said rotationally symmetric container, wherein said channel spirals helically from said inlet end to said outlet end.

13. The device of claim 12, further comprising:

means for rotating said rotationally symmetric container in a direction, so that when said inlet end is in communication with a fluid and when the container is floating with its axis upright and rotated in said direction, said fluid is caused to flow upwardly in said channel spiralling helically from said inlet end to said outlet end of said rotationally symmetric container and be discharged therefrom.

14. A fluid pump comprising:

an inlet reservoir for holding a volume of fluid, a pump flotation chamber for holding a volume of fluid, a rotationally symmetric container having an inlet end and an outlet end, said rotationally symmetric container floating disposed in an upright position in said fluid contained in said pump flotation chamber, at least one channel for conveying fluid from said inlet end to said outlet end, said channel located proximate the periphery of said rotationally symmetric container, and means for rotating said rotationally symmetric container in a direction to cause said fluid to flow upwardly in said channel spiralling helically from said inlet end to said outlet end of said rotationally symmetric container and be discharged therefrom.

* * * * *